US008232034B2

(12) United States Patent
Kang et al.

(10) Patent No.: US 8,232,034 B2
(45) Date of Patent: Jul. 31, 2012

(54) ELECTROPHOTOGRAPHIC TONER AND METHOD OF PREPARING THE SAME

(75) Inventors: Kyung-yeon Kang, Suwon-si (KR); Sang-yup Kim, Suwon-si (KR); Hong-chul Shin, Suwon-si (KR); Sung-jin Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 51 days.

(21) Appl. No.: 12/853,341

(22) Filed: Aug. 10, 2010

(65) Prior Publication Data

US 2011/0159427 A1 Jun. 30, 2011

(30) Foreign Application Priority Data

Dec. 29, 2009 (KR) ..... 2009-132831

(51) Int. Cl.
*G03G 9/00* (2006.01)

(52) U.S. Cl. ..... 430/108.1; 430/108.6; 430/108.7; 430/110.2; 430/137.13

(58) Field of Classification Search ..... 430/108.1, 430/108.6, 108.7, 110.2, 137.13
See application file for complete search history.

(56) References Cited

U.S. PATENT DOCUMENTS 5,759,731 A 6/1998 Hagi et al.
2009/0155700 A1 6/2009 Pang et al.

OTHER PUBLICATIONS

European Search Report issued Apr. 6, 2011 in EP Application No. 10197266.9.

*Primary Examiner* — Mark A Chapman
(74) *Attorney, Agent, or Firm* — Stanzione & Kim, LLP

(57) ABSTRACT

The disclosure provides an electrophotographic toner and methods for preparing the electrographic toner. The electrographic toner includes a binder, a colorant and a releasing agent, wherein the electrophotographic toner includes strontium (Sr), iron (Fe), titanium (Ti), and silicon (Si) containing particles; wherein, if [Sr], [Fe], [Ti] and [Si] denote the intensities of Sr, Fe, Ti, and Si in the electrophotographic toner, respectively, as measured by X-ray fluorescence spectrometry, then the [Sr]/[Fe] ratio is in the range of about $5.0\times10^{-1}$ to about 4.5, the [Ti]/[Fe] ratio is in the range of about $5.0\times10^{-1}$ to about $8.1\times10^{-1}$, and the [Si]/[Fe] ratio is in the range of about $2.0\times10^{-3}$ to about $4.0\times10^{-3}$.

17 Claims, 2 Drawing Sheets

ELECTROPHOTOGRAPHIC TONER AND METHOD OF PREPARING THE SAME

CROSS-REFERENCE TO RELATED APPLICATIONS

This application claims the benefit of Korean Patent Application No. 10-2009-0132831, filed in the Korean Intellectual Property Office on Dec. 29, 2009, the disclosure of which is hereby incorporated by reference in its entirety for all purposes.

BACKGROUND

1. Field of the Invention

The disclosure generally relates to an electrophotographic toner and a method of preparing the electrophotographic toner.

2. Description of the Related Art

Developers for visualizing electrostatic images and electrostatic latent images in electrographic and electrostatic processes may be classified into two-component developers and one-component developers. Two-component developers include toner and carrier particles whereas one-component developers consist exclusively of toner. One-component developers can be further classified into magnetic and nonmagnetic developers. In order to increase the fluidity of toner, nonmagnetic one-component developers often contain a fluidizing agent, such as colloidal silica. Typically, toner also includes coloring particles obtained by dispersing a colorant, such as carbon black, or other additives, in latex.

Methods for preparing toner include pulverization and polymerization processes. For pulverization processes, toner is obtained by melting and mixing a synthetic resin with a colorant, and optionally, other additives. After pulverizing, this mixture undergoes sorting until the particles of the desired size are obtained. In contrast, polymerization processes provide toner by uniformly dissolving or dispersing various additives, such as a colorant, a polymerization initiator and, optionally, a cross-linking agent and an antistatic agent, in a polymerizable monomer. The polymerizable monomer composition is then dispersed in an aqueous dispersive medium, which includes a dispersion stabilizer, using an agitator to shape minute liquid droplet particles. The temperature of the composition is subsequently increased, and suspension polymerization is performed to obtain polymerized toner having coloring polymer particles of the desired size.

Conventionally, toner used in an imaging apparatus is obtained by pulverization. However, for pulverization processes it is difficult to precisely control the particle size, geometric size distribution, and the structure of toner. Thus, it is difficult to control the major characteristics of toner, such as charging characteristics, fixability, flowability, and preservation characteristics using these processes.

Recently, the use of polymerized toner has increased due to the simpler manufacturing process, which does not require sorting the particles, and the ease of controlling the size of the particles. When toner is prepared through a polymerization process, polymerized toner having a desired particle size and particle size distribution can be obtained without pulverizing or sorting. In order to control the particle size and shape of toner to be uniform in a polymerization process, an agglomeration process for preparing agglomerated toner may be used through the use of a metal salt such as $MgCl_2$, and the like, or a polymeric material such as polyaluminum chloride (PAC).

By using a metal salt-based agglomerating agent it is possible to control the particle size and particle size distribution of toner or to reproducibly form a capsule structure with a shell. Typically, the particle size above a middle point of the particle size distribution of toner is highly controllable, however, smaller toner particles below the middle point of the particle size distribution tend to be more spherical than desired, and may cause problems in blade cleaning during electrophotographic processes. When PAC is used, the particle size and shape of toner can be uniformly controlled and toner has a stronger agglomerating force. The use of aluminum substances however, is restricted due to their effects on the environment.

SUMMARY

The disclosure provides an electrophotographic toner and methods of preparing the electrophotographic toner.

In one aspect, the disclosure provides an electrophotographic toner including a binder, a colorant and a releasing agent, wherein the electrophotographic toner includes strontium (Sr), iron (Fe), titanium (Ti), and silicon (Si) containing particles; wherein, if [Sr], [Fe], [Ti] and [Si] denote the intensities of Sr, Fe, Ti, and Si in the electrophotographic toner, respectively, as measured by X-ray fluorescence spectrometry, then the [Sr]/[Fe] ratio is in the range of about $5.0\times10^{-1}$ to about 4.5, the [Ti]/[Fe] ratio is in the range of about $5.0\times10^{-1}$ to about $8.1\times10^{-1}$, and the [Si]/[Fe] ratio is in the range of about $2.0\times10^{-3}$ to about $4.0\times10^{-3}$.

In another aspect the disclosure provides an electrophotographic toner, wherein Sr is in the form of Sr-containing particles having a volume average particle diameter (D50v) of about 200 to about 500 nm, and having a volume average particle size distribution, which is represented by [(D84v−D16v)/2], of about 0.1 or less, wherein the volume average particle diameters D16v, D50v and D84v denote cumulative particle diameters at 16%, 50%, and 84%, respectively, of the cumulative volume distribution of toner particles measured using the Coulter method.

In another aspect the disclosure provides an electrophotographic toner, wherein the Sr-containing particles comprise at least one selected from the group consisting of strontium titanate, strontium oxide, strontium carbonate, and strontium sulfate.

In another aspect the disclosure provides an electrophotographic toner, wherein Si is in the form of Si-containing particles comprising large-diameter Si-containing particles having a volume average particle diameter of about 30 nm to about 100 nm; and small-diameter Si-containing particles having a volume average particle diameter of about 5 nm to about 20 nm.

In another aspect the disclosure provides an electrophotographic toner, wherein the Si-containing particles comprise silica.

In another aspect the disclosure provides an electrophotographic toner, wherein the amount of each of Si and Fe is in the range of about 3 to about 30,000 ppm.

In another aspect the disclosure provides an electrophotographic toner, wherein the average particle diameter of the electrophotographic toner is in the range of about 3 to about 9.5 μm.

In another aspect the disclosure provides an electrophotographic toner, wherein the average circularity of the electrophotographic toner is in the range of about 0.945 to about 0.985.

In another aspect the disclosure provides an electrophotographic toner, wherein the volume average particle diameter distribution coefficient (GSDv) of the toner is about 1.25 or less, and the number average particle diameter distribution coefficient (GSDp) is about 1.3 or less.

In another aspect the disclosure provides methods for preparing an electrophotographic toner, by: a) mixing primary binder particles, a colorant dispersion and a releasing agent dispersion together to produce a mixed solution; b) adding an agglomerating agent to the mixed solution to produce core-layer particles; and c) coating the core-layer particles with shell-layer particles to produce the electrographic toner, wherein the shell-layer particles comprise secondary binder particles prepared by polymerizing at least one polymerizable monomer.

In another aspect the disclosure provides methods for preparing an electrophotographic toner, wherein coating the core-layer particles with shell-layer particles of step c) includes: d) agglomerating the core-layer particles and the shell-layer particles at a temperature at which the core-layer particles and the shell-layer particles have a shear storage modulus (G') of about $1.0\times10^8$ to about $1.0\times10^9$ Pa; e) stopping the agglomerating in step d) when the average particle diameter reaches about 70% to about 100% of the average particle diameter of the electrographic toner, to provide toner particles; and f) fusing and coalescing the toner particles obtained in step e) at a temperature at which the toner particles have a shear storage modulus (G') of about $1.0\times10^4$ to about $1.0\times10^9$ Pa.

In another aspect the disclosure provides methods for preparing an electrophotographic toner, further comprising coating the secondary toner particles with tertiary binder particles.

In another aspect the disclosure provides methods for preparing an electrophotographic toner, wherein the releasing agent dispersion comprises a paraffin-based wax and an ester-based wax.

In another aspect the disclosure provides methods for preparing an electrophotographic toner, wherein the amount of the ester-based wax is in the range of about 1 to about 35 parts by weight % based on the total weight of the paraffin-based wax and the ester-based wax.

In another aspect the disclosure provides methods for preparing an electrophotographic toner, wherein the agglomerating agent comprises a Si- and Fe-containing metal salt.

In another aspect the disclosure provides methods for preparing an electrophotographic toner, wherein the agglomerating agent comprises polysilicate iron.

In another aspect the disclosure provides methods for preparing an electrophotographic toner, wherein the agglomerating agent is added at a pH of about 2.0 or less.

BRIEF DESCRIPTION OF THE DRAWINGS

Various features and advantages of the disclosure will become more apparent by describing in detail exemplary embodiments thereof with reference to the attached drawings in which.

DETAILED DESCRIPTION OF THE EMBODIMENTS

Figure 1:
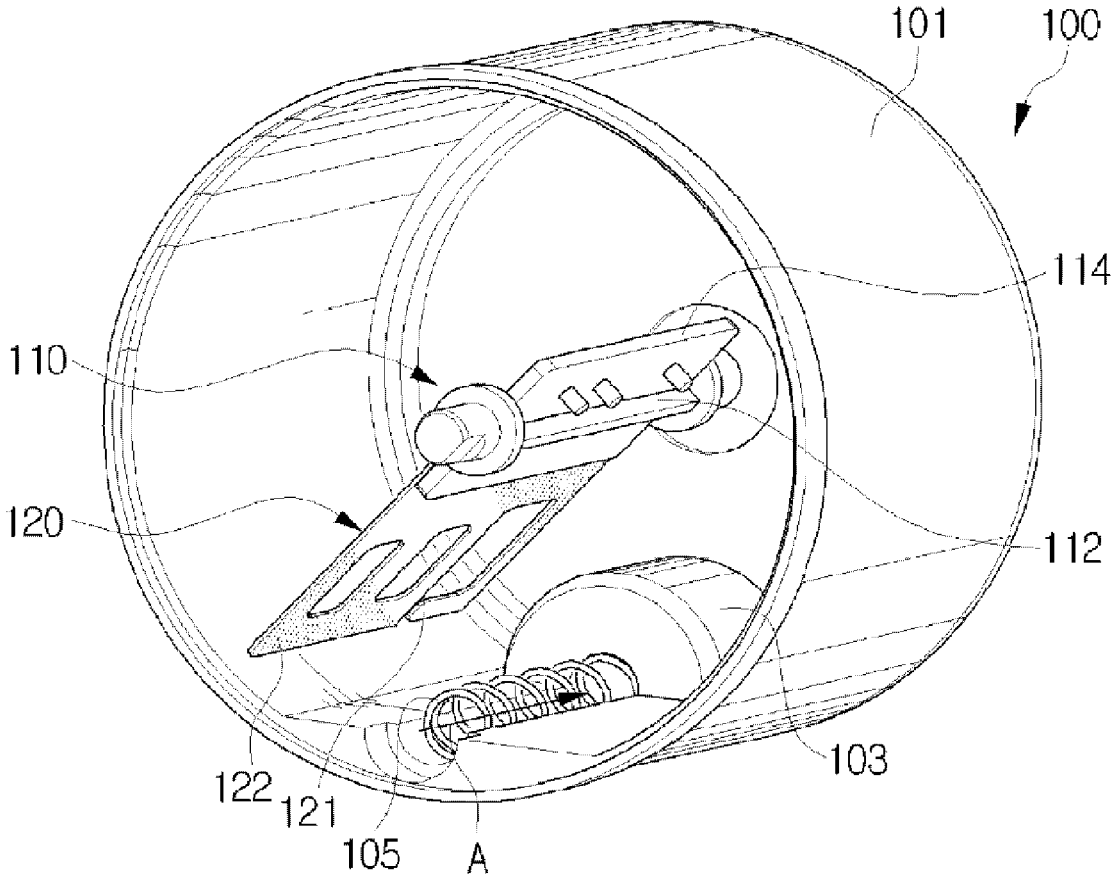
FIG. 1 is a perspective view of a toner supplying unit.

The disclosure will now be described more fully with reference to the accompanying drawings, in which exemplary embodiments of the disclosure are shown.

According to an aspect of the disclosure, an electrophotographic toner includes a binder, a colorant and a releasing agent, wherein the electrophotographic toner includes strontium (Sr), iron (Fe), titanium (Ti), and silicon (Si) containing particles; wherein, if [Sr], [Fe], [Ti] and [Si] denote the intensities of Sr, Fe, Ti, and Si in the electrophotographic toner, respectively, as measured by X-ray fluorescence spectrometry, then the [Sr]/[Fe] ratio is in the range of about 5.0×10−1 to about 4.5, the [Ti]/[Fe] ratio is in the range of about 5.0×10−1 to about 8.1×10−1, and the [Si]/[Fe] ratio is in the range of about 2.0×10−3 to about 4.0×10−3.

As used herein, [Sr] corresponds to the amount of Sr contained in Sr-containing particles that are externally added to the toner for long-life durability and excellent charging characteristics. Thus, [Sr] may affect the agglomeration properties, the particle distribution and the particle size of agglomerated toner. The agglomerated toner may be a precursor for preparing a final toner.

As used herein, [Fe] corresponds to the amount of Fe contained in an agglomerating agent that is used to agglomerate the latex, the colorant and the releasing agent when preparing the toner. Thus, [Fe] may affect the agglomeration properties, the particle distribution and the particle size of agglomerated toner. The agglomerated toner may be a precursor for preparing a final toner.

As used herein, [Ti] corresponds to the amount of Ti contained in Ti-containing particles that are externally added when preparing the toner for flowability, developing properties, and durability. Thus, [Ti] may affect the agglomeration properties, the particle distribution and the particle size of agglomerated toner. The agglomerated toner may be a precursor for preparing a final toner.

As used herein, [Si] corresponds to the amount of Si contained in Si-containing particles that are externally added for the flowability of the toner, and polysilicate which is contained in the agglomerating agent. Thus, [Si] may affect the agglomeration properties, the particle distribution and the particle size of agglomerated toner. The agglomerated toner may be a precursor for preparing a final toner.

The [Sr]/[Fe] ratio may be, for example, in the range of about $5.0\times10^{-1}$ to about 4.5, about 1.0 to about 4.3, or about 1.2 to about 4.2. If the [Sr]/[Fe] ratio is within the range of about $5.0\times10^{-1}$ to about 4.5, the toner may have long-life durability and have excellent charging characteristics due to a higher initial charging rate. A charge-up that may occur in low-temperature, low-humidity conditions and a charge-down that may occur in high-temperature, high-humidity conditions may be prevented. The toner may have a high transfer efficiency even after a large number of printing operations have been performed.

The [Ti]/[Fe] ratio may be, for example, in the range of about $5.0\times10^{-1}$ to about $8.0\times10^{-1}$, about $5.5\times10^{-1}$ to about $7.5\times10^{-1}$, or about $6.0\times10^{-1}$ to about $7.0\times10^{-1}$. If the [Ti]/[Fe] ratio is within the range of about $5.0\times10^{-1}$ to about $8.0\times10^{-1}$, the toner may have higher resistance to abrasion against the surface of a photoreceptor. A charge-up that may occur in low-temperature, low-humidity conditions and a charge-down that may occur in high-temperature, high-humidity conditions may be prevented. The toner may have a high transfer efficiency even after a large number of printing operations have been performed.

The [Si]/[Fe] ratio may be, for example, in the range of about $2.0\times10^{-3}$ to about $4.0\times10^{-3}$, about $2.3\times10^{-3}$ to about $3.7\times10^{-3}$, or about $2.5\times10^{-3}$ to about $3.5\times10^{-3}$. If the [Si]/[Fe] ratio is within the range of about $2.0\times10^{-3}$ to about $4.0\times10^{-3}$, the flowability of the toner may be improved, and contamination of the inside of a printer due to toner may be prevented. A charge-up that may occur in low-temperature, low-humidity conditions and a charge-down that may occur in high-temperature, high-humidity conditions may be prevented. The toner may have a high transfer efficiency even after a large number of printing operations have been performed.

The toner may have a volume average particle diameter of, for example, about 3 to about 9.5 μm, about 4 to about 9 μm, or about 4.5 to about 8.5 μm, and may have an average circularity of, for example, about 0.945 to about 0.985, about 0.950 to about 0.980, or about 0.955 to about 0.975. In general, the smaller toner particle size, the higher the resolution and the higher the quality of an image may be achieved. When transfer speed and cleansing force are taken into consideration however, small toner particles may not be appropriate for all applications. Thus, the appropriate toner particle diameter is an important consideration.

The volume average particle diameter of toner may be measured by electrical impedance analysis. When the volume average particle diameter of toner is greater than or equal to about 3 μm, it may be easier to clean a photoreceptor, mass-production yield may be improved, and no harmful effects on the human body are caused due to scattering. On the other hand, when the volume average particle diameter of toner is equal to or less than about 9.5 μm, this may lead to uniform charging, may improve fixing characteristics of toner, and may make it easier to regulate the toner layer with a doctor blade.

The circularity of toner may be measured using a flow particle image analyzer (e.g., the FPIA-3000 particle analyzer available from SYSMEX Corporation of Kobe, Japan), and using the following equation:

$$\text{Circularity}=2\times(\pi\times\text{area})^{0.5}/\text{circumference}$$

The circularity may be in the range of 0 to 1, and as the circularity approaches 1, toner particle shape becomes more circular. When the electrophotographic toner has an average circularity of 0.945 or greater, an image developed on a transfer medium may have an appropriate thickness, and thus toner consumption may be reduced. In addition, voids between toner particles are not too large, and the image developed on the transfer medium may have a sufficient coating rate. On the other hand, when the electrophotographic toner has an average circularity of 0.985 or less, an excessive amount of toner being supplied onto a development sleeve may be prevented, making it possible to reduce the contamination of the development sleeve that may result from the non-uniform coating of toner.

The toner particle distribution coefficients may include a volume average particle size distribution coefficient (GSDv) or a number average particle size distribution coefficient (GSDp), which may be measured as follows. First, a toner particle size distribution is obtained from toner particle diameters measured using a particle sizing and counting analyzer, for example, the Multisizer™ III available from Beckman Coulter, Inc. of Fullerton, Calif., U.S.A. Next, the toner particle diameter distribution is divided into predetermined particle diameter ranges (channels). Finally, with respect to the respective particle diameter ranges (channels), the cumulative volume distribution of toner particles and the cumulative number distribution of toner particles are measured. In each of the cumulative volume and number distributions, the particle size in each distribution is increased in a direction from left to right. A cumulative particle diameter at 16% of the respective cumulative distributions is defined as a volume average particle diameter D16v and a number average particle diameter D16p; a cumulative particle diameter at 50% of the respective cumulative distributions is defined as a volume average particle diameter D50v and a number average particle diameter D50p; and a cumulative particle diameter at 84% of the respective cumulative distributions is defined as a volume average particle diameter D84v and a number average particle diameter D84p.

The GSDv and the GSDp may be obtained using the relations that the GSDv is defined as $(D84v/D16v)^{0.5}$, and the GSDp is defined as $(D84p/D16p)^{0.5}$. The GSDv may be, for example, about 1.25 or less, or in the range of about 1.15 to about 1.20. The GSDp may be, for example, about 1.30 or less, in the range of about 1.15 to about 1.30, or in the range of about 1.20 to about 1.25. When each of the GSDv and GSDp is within the above range, the electrophotographic toner may have a uniform particle diameter.

According to another aspect the disclosure provides methods of preparing the electrophotographic toner by: a) mixing primary binder particles, a colorant dispersion, and a releasing agent dispersion to provide a mixed solution; b) adding an agglomerating agent to the mixed solution to provide core-layer particles; and c) coating the core-layer particles with shell-layer particles containing secondary binder particles to provide toner particles, wherein the secondary binder particles are prepared by polymerizing at least one polymerizable monomer, and wherein the electrophotographic toner includes strontium (Sr), iron (Fe), titanium (Ti), and silicon (Si) containing particles; wherein, if [Sr], [Fe], [Ti] and [Si] denote the intensities of Sr, Fe, Ti, and Si in the electrophotographic toner, respectively, as measured by X-ray fluorescence spectrometry, then the [Sr]/[Fe] ratio is in the range of about $5.0\times10^{-1}$ to about 4.5, the [Ti]/[Fe] ratio is in the range of about $5.0\times10^{-1}$ to about $8.1\times10^{-1}$, and the [Si]/[Fe] ratio is in the range of about $2.0\times10^{-3}$ to about $4.0\times10^{-3}$.

In the methods for preparing the electrographic toner, the primary binder particles may consist exclusively of polyester, or may include a polymer synthesized by polymerizing at least one polymerizable monomer, or a mixture thereof (hybrid). When the primary binder particles include a polymer, at least one polymerizable monomer may be polymerized together with a releasing agent, such as wax, to synthesize the polymer. Alternatively, a polymer may be used as a mixture with a releasing agent.

The polymerization process may be an emulsion polymerization distribution process to produce primary binder particles having a particle size of, for example, about 1 μm or less, in the range of about 100 to about 300 nm, or in the range of about 150 to about 250 nm.

The polymerizable monomer used herein may include, but is not limited to, styrene-based monomers such as styrene, vinyltoluene, α-methylstyrene; acrylic acids, methacrylic acids, and the like; derivatives of (meth)acrylic acid such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylo-nitrile, acrylamide, methacrylamide, and the like; ethylenically unsaturated monoolefines such as ethylene, propylene, butylene, and the like; halogenated vinyls such as vinyl chloride, vinylidene chloride, vinyl fluoride, and the like; vinyl esters such as vinyl acetate, vinyl propionate, and the like; vinyl ethers such as vinylmethylether, vinylethyl-ether, and the like; vinyl ketones such as vinylmethylketone, methylisoprophenylketone, and the like; and nitrogen-containing vinyl compounds such as 2-vinylpyridine, 4-vinylpyridine, N-vinylpyrrolidone, and the like.

When the primary latex particle is manufactured, a polymerization initiator and a chain transfer agent may be further used to efficiently perform the polymerization process.

Examples of the polymerization initiator include, but is not limited to, persulfates such as potassium persulfate, ammonium persulfate, and the like; azo compounds such as 4,4-azobis(4-cyano valeric acid), dimethyl-2,2'-azobis(2-methylpropionate), 2,2-azobis(2-amidinopropane)dihydrochloride, 2,2-azobis-2-methyl-N-1,1-bis(hydroxy-methyl)-2-hydroxyethylpropioamide, 2,2'-azobis(2,4-dimethylvalero-nitrile), 2,2'-azobisisobutyronitrile, 1,1'-azobis(1-cyclohexancarbonitrile), and the like; and peroxides such as methylethylperoxide, di-t-butylperoxide, acetylperoxide, dikumyl-peroxide, lauroylperoxide, benzoyl peroxide, t-butylperoxy-2-ethylhexanoate, di-isopropyl-peroxydicarbonate, di-t-butyl peroxyisophthalate, and the like. Oxidation-reduction initiators prepared by combining these polymerization initiators and reductants may also be used as the polymerization initiator.

A chain transfer agent refers to a material that changes the type of a chain carrier during a chain reaction, or a material that significantly reduces the activity of a new chain compared to that of existing chains. As a result of using the chain transfer agent, the degree of polymerization of polymerizable monomers may be reduced, and the reaction for a new chain may be initiated. As a result of using a chain transfer agent, the molecular weight distributions of toner may also be controlled. The amount of the chain transfer agent may be, for example, in the range of about 0.1 to about 5 parts by weight, about 0.2 to about 3 parts by weight, or about 0.5 to about 2.0 parts by weight, based on 100 parts by weight of the at least one polymerizable monomer. If the amount of the chain transfer agent is within the above range, agglomeration effects and fixing characteristics may be improved.

Examples of the chain transfer agent include, but is not limited to, sulfur-containing compounds such as dodecanethiol, thioglycolic acid, thioacetic acid, mercaptoethanol, and the like; phosphorous acid compounds such as a phosphorous acid sodium phosphorous acid, and the like; hypophosphorous acid compounds such as a hypophosphorous acid, sodium hypophosphorous acid, and the like; and alcohols such as methyl alcohol, ethyl alcohol, isopropyl alcohol, n-butyl alcohol, and the like.

The primary binder particles may further include a charge control agent. The charge control agent may be a negatively charged charge control agent or a positively charged charge control agent. Examples of the negatively charged charge control agent include, but is not limited to, organic metal complexes such as a chromium containing azo complex, a mono-azo metal complex, chelate compounds, and the like; metal-containing salicylic acid compounds wherein the metal may be chromium, iron, zinc, and the like; and organic metal complexes such as aromatic hydroxycarboxylic acids, aromatic dicarboxylic acid, and the like. The positively charged charge control agent may be a modified product, such as nigrosine or a fatty acid metal salt thereof; or an onium salt including, but not limited to, a quaternary ammonium salt such as tributylammonium 1-hydroxy-4-naphthosulfonate tetrabutyl-ammonium tetrafluoro borate, and the like. The charge control agent may be used alone or in combination. The charge control agent may operate to stably support toner on a development roller with an electrostatic force. Thus, by using the charge control agent, stable and high-speed charging may be ensured.

The primary binder particles obtained may be mixed with the colorant dispersion and the releasing agent dispersion to prepare a mixed solution. The colorant dispersion may be obtained by uniformly dispersing a composition including a colorant, such as a black colorant, a cyan colorant, a magenta colorant, or a yellow colorant, and an emulsifier by using an ultrasonic homogenizer or a micro fluidizer.

Among colorants used to prepare the colorant dispersion, the black colorant may be carbon black or aniline black. For color toner, at least one colorant is selected from cyan colorant, magenta colorant, and yellow colorant, which may be further used in addition to the black colorant.

The yellow colorant may include, but is not limited to a condensed nitrogen compound, an isoindolinone compound, an anthraquinone compound, an azo metal complex, an alkyl imide compound, and the like. Examples of the yellow colorant include, but is not limited to, C.I. pigment yellows 12, 13, 14, 17, 62, 74, 83, 93, 94, 95, 109, 110, 111, 128, 129, 147, 168, 180, and the like.

Examples of the magenta colorant include, but is not limited to, condensed nitrogen compounds, anthraquine compounds, quinacridone compounds, base dye lake compounds, naphthol compounds, benzo imidazole compounds, thioindigo compounds, perylene compounds, and the like. Specifically, examples of the magenta colorant include, but is not limited to, C.I. pigment reds 2, 3, 5, 6, 7, 23, 48:2, 48:3, 48:4, 57:1, 81:1, 122, 144, 146, 166, 169, 177, 184, 185, 202, 206, 220, 221, 254, and the like.

Examples of the cyan colorant include, but is not limited to, copper phthalocyanine compounds and derivatives thereof, anthraquinone compounds, base dye lake compounds, and the like. Specifically, examples of the cyan colorant include, but is not limited to, C.I. pigment blues 1, 7, 15, 15:1, 15:2, 15:3, 15:4, 60, 62, 66, and the like.

These colorants may be used alone or in combination, and may be selected in consideration of color, chromaticity, brightness, weather resistance, or dispersibility in toner.

The amount of the colorant used to prepare the colorant dispersion may be in the range of about 0.5 to about 15 parts by weight, about 1 to about 12 parts by weight, or about 2 to about 10 parts by weight, based on 100 parts by weight of toner. If the amount of the colorant is within the above range, a sufficient coloring effect and a sufficient friction electrification quantity may be obtained without a cost increase.

The emulsifier used to prepare the colorant dispersion may be any emulsifier known to those skilled in the art. For example, the emulsifier may be an anionic reactive emulsifier, a non-ionic reactive emulsifier, or a mixture thereof. The anionic reactive emulsifier may be HS-10 (available from Dai-Ichi Kogyo Seiyaku Co., Ltd.) or DOWFAX™ 2A1 (available from The Dow Chemical Company. The non-ionic reactive emulsifier may be RN-10 (available from Dai-Ichi Kogyo Seiyaku Co., Ltd.).

The releasing agent dispersion used in the method of preparing the electrophotographic toner may include a releasing agent, water, or an emulsifier. The releasing agent enables toner to be fixed to a final-image receptor at a low fixing temperature and to have excellent final image durability and resistance to abrasion. Thus, characteristics of toner are very dependent on the type and amount of the releasing agent.

Examples of suitable releasing agents include, but is not limited to, polyethylene-based wax, polypropylene-based wax, silicon wax, paraffin-based, ester-based wax, carnauba wax, metallocene wax, and the like. The releasing agent may have a melting point of about 50° C. to about 150° C. The releasing agent may be physically attached to toner particles, but not covalently bonded with toner particles, which enables toner to be fixed to a final image receptor at a low fixing temperature and to have excellent final image durability and abrasion-resistance characteristics. The amount of the releasing agent may be in the range of about 1 to about 20 parts by weight, about 2 to about 16 parts by weight, or about 3 to about 12 parts by weight, based on 100 parts by weight of the toner. If the amount of the releasing agent is within the above range, the low-temperature characteristics of the toner may be improved with a wider fixing temperature range, and preservation characteristics may be improved without a cost increase.

The releasing agent may be an ester group-containing wax. Examples of the ester group-containing wax include a mixture of an ester-based wax and a non-ester based wax; and an ester group-containing wax prepared by adding an ester group to a non-ester based wax. Since an ester group has high affinity with respect to the binder component of the electrophotographic toner, the wax may be uniformly distributed among toner particles, and may effectively function. The non-ester based wax has a releasing effect on the binder, and may suppress excessive plasticizing reactions, which occurs when an ester-based wax is exclusively used. The toner may retain satisfactory development characteristics for a long period of time.

Examples of the ester-based wax include, but is not limited to, esters of monovalent to pentavalent alcohols and $C_{15}$-$C_{30}$ fatty acids such as behenic acid behenyl, staric acid stearyl, stearic acid ester of pentaeritritol, montanic acid glyceride, and the like. If an alcohol component constituting the ester is a monovalent alcohol, it may include 10 to 30 carbon atoms. If an alcohol component constituting the ester is a polyvalent alcohol, it may include 3 to 10 carbon atoms.

The non-ester based wax may be polymethylene-based wax or paraffin-based wax.

Examples of the ester group-containing wax include, but is not limited to, a mixture of a paraffin-based wax and an ester-based wax; and an ester group-containing paraffin-based wax. Examples of the ester group-containing wax may also include P-280, P-318, and P-319 (available from Chukyo Yushi Co., Ltd. of Nagoya, Japan).

If the releasing agent is a mixture of a paraffin-based wax and an ester based wax, the amount of the ester-based wax in the releasing agent may be, for example, in the range of about 1 to about 35 weight %, about 3 to about 33 weight %, or about 5 to about 30 weight %, based on the total weight of the releasing agent.

When the amount of the ester-based wax is greater than or equal to about 1 weight % based on the total weight of the releasing agent, the compatibility of the ester-based wax with the primary latex particles may be sufficiently maintained. When the amount of the ester-based wax is less than or equal to about 35 weight % based on the total weight of the releasing agent, toner may have appropriate plasticizing characteristics, and may retain satisfactory development characteristics for a long period of time. Anti-offset characteristics at high temperatures and gloss may also be improved.

Like the emulsifier used in the colorant dispersion, any emulsifier that is used in the art may be used as an emulsifier for the releasing agent dispersion. Examples of the emulsifier available for the releasing agent dispersion may include, but is not limited to, an anionic reactive emulsifier, a non-ionic reactive emulsifier, and the like, and mixtures thereof. The anionic reactive emulsifier may be HS-10 (Dai-Ichi Kogyo Seiyaku Co., Ltd.) or DOWFAX™ 2A1 (The Dow Chemical Company). The non-ionic reactive emulsifier may be RN-10 (Dai-Ichi Kogyo Seiyaku Co., Ltd.).

The molecular weight, glass transition temperature ($T_g$) and the rheological characteristics of the primary binder particles obtained by the methods disclosed herein, may be appropriately controlled in such a way that toner may be fixed at low temperature.

The primary binder particles, the colorant dispersion and the releasing agent dispersion are mixed to obtain a mixed solution. An agglomerating agent is added to the mixed solution to prepare an agglomerated toner. For example, the primary binder particles, the colorant dispersion, and the releasing agent dispersion are mixed, and the agglomerating agent is added at a pH of about 1 to about 2.0, thereby preparing core-layer particles having a volume average particle diameter of 2.5 μm or less. The secondary binder particles are added, and the pH of the system is adjusted to about 6 to about 8 and left until the particle size of the mixture is maintained constant for a predetermined period of time. The temperature of the mixture is raised to 90 to 98° C. and the pH is lowered to 5 to 6 in order to coalesce the mixture into toner particles.

Examples of the agglomerating agent may include, but is not limited to, NaCl, $MgCl_2$, MgCl2.8H20, ferrous sulfate, ferric sulfate, ferric chloride, calcium hydroxide, calcium carbonate, Si- and Fe-containing metal salts, and the like. The amount of the agglomerating agent may be, for example, in the range of about 0.1 to about 10 parts by weight, about 0.5 to about 8 parts by weight, or about 1 to about 6 parts by weight, based on 100 parts by weight of the primary binder particles. If the amount of the agglomerating agent is within the above range, agglomeration effects and charging characteristics may be improved, and the toner may have a uniform particle size distribution.

The disclosed electrophotographic toner may be prepared by using a Si- and Fe-containing metal salt as an agglomerating agent. In the electrophotographic toner, the amounts of Si and Fe may each be, for example, in the range of about 3 to about 30,000 ppm, about 30 to about 25,000 ppm, or about 300 to about 20,000 ppm. If the amount of Si and Fe is within the above range, agglomeration effects and charging characteristics may be improved, and contamination of the inside of the printer due to toner may be prevented.

The Si- and Fe-containing metal salt may include, for example, polysilicate iron. In particular, due to the ionic strength increased by the addition of the Si and Fe-containing metal salt, and particle-to-particle collisions, the size of the toner may be increased. The Si- and Fe-containing metal salt may be polysilicate iron. Examples of the Si- and Fe-containing metal may include, but is not limited to, PSI-025, PSI-050, PSI-075, PSI-100, PSI-200, PSI-300, and the like, which are products manufactured by Suido Kiko Co. Table 1 shows the physical properties and compositions of PSI-025, PSI-050, PSI-075, PSI-100, PSI-200, and PSI-300.

TABLE 1

| Type | | PSI-025 | PSI-050 | PSI-085 | PSI-100 | PSI-200 | PSI-300 |
|---|---|---|---|---|---|---|---|
| Si/Fe mole ratio | | 0.25 | 0.5 | 0.85 | 1 | 2 | 3 |
| Main component | Fe(wt %) | 5.0 | 3.5 | 2.5 | 2.0 | 1.0 | 0.7 |
| (concentration) | $SiO_2$(wt %) | 1.4 | 1.9 | 2.0 | | 2.2 | |
| pH(1 w/v %) | | | | 2-3 | | | |
| Specific gravity(20° C.) | | 1.14 | 1.13 | 1.09 | 1.08 | 1.06 | 1.04 |
| Viscosity (mPa · S) | | | | 2.0 or greater | | | |

TABLE 1-continued

| Type | PSI-025 | PSI-050 | PSI-085 | PSI-100 | PSI-200 | PSI-300 |
|---|---|---|---|---|---|---|
| Average molecular weight (Dalton) | | | 500,000 | | | |
| Appearance | | | transparent, yellowish brown liquid | | | |

By using the Si- and Fe-containing metal salt as an agglomerating agent in preparing the electrophotographic toner, the particle size of the toner may become small, and the particle shape may also be controllable.

The agglomerating agent may be added, for example, at pH 2.0 or less, at a pH of about 0.1 to about 2.0, at a pH of about 0.3 to about 1.8, or at a pH of about 0.5 to about 1.6. If the pH is within the above range, it may be easy to handle the mixture solution. Fe contained in the agglomerating agent may effectively eliminate the odor of the charge transfer agent, i.e., a sulfur-containing compound, used to prepare binder. The agglomeration effects may also be improved.

The secondary binder particles may be obtained by polymerizing at least one polymerizable monomer. The polymerization process may be an emulsion polymerization distribution process to produce secondary binder particles having a size of about 1 μm or less, for example, in the range of about 100 to about 300 nm. The secondary binder particles may include a releasing agent, which may be incorporated into the secondary binder particles in the polymerization process.

In particular, in the method of preparing the electrophotographic toner, the coating of the core-layer particles with the shell-layer particles to provide toner particles may include: a) agglomerating the core-layer particles and the shell-layer particles at a temperature at which the core-layer particles and the shell-layer particles have a shear storage modulus (G') of about $1.0\times10^8$ to about $1.0\times10^9$ Pa; b) stopping the agglomerating when the average particle diameter of the particles obtained in operation a) reaches about 70% to about 100% of the average particle diameter of the final toner particles; and fusing and coalescing the particles obtained in operation b) at a temperature at which the particles obtained in operation b) have a shear storage modulus (G') of about $1.0\times10^4$ to about $1.0\times10^9$ Pa.

The agglomerating of the core-layer particles and the shell-layer particles is a physical agglomeration process. This process may be performed at a temperature at which the core-layer particles and the shell-layer particles have a shear storage modulus (G') of about $1.0\times10^8$ to about $1.0\times10^9$ Pa in order to prevent the core-layer particles and the shell-layer particles from being fused earlier than expected. This may be favorable for controlling the particle size distribution of toner.

The fusing and coalescing of the particles obtained in operation b) may be performed by heating the particles at a temperature at which the particles have a shear storage modulus (G') of about $1.0\times10^4$ to about $1.0\times10^9$ Pa, i.e., a temperature about 10° C. to about 30° C. higher than or equal to the melting point of the particles obtained in operation b).

After the secondary binder particles, which constitute shell-layer particles, are added to the core-layer particles, the pH of the system is adjusted to about 6 to about 9 and left until a particle size of the mixture is maintained constant for a predetermined period of time. The temperature is raised to about 90 to about 98° C., and the pH is lowered to about 5 to about 6 in order to coalesce the mixture into the toner particles. Tertiary binder particles prepared by polymerizing the at least one polymerizable monomer may be further coated on the toner particles. By forming the shell layer from the secondary binder particles, or the secondary and tertiary binder particles, toner may have higher durability and excellent preservation characteristics during shipping and handling. A polymerization inhibitor may be further added to prevent formation of new binder particles. A mixed monomer solution may be coated on core-layer particles in starved-feeding conditions to ensure coating quality.

The obtained toner particles are then filtered, separated and dried. An external additive is added to the dried toner particles. The amount of charge applied may be controlled, thereby obtaining final dry toner. Examples of the external additive include Si-containing particles, Ti-containing particles, and Sr-containing particles.

The Si-containing particles may include large-diameter Si-containing particles having a volume average particle diameter of about 30 nm to about 100 nm and small-diameter Si-containing particles having a volume average particle diameter of about 5 nm to about 20 nm. An example of the Si-containing particles may include, but is not limited to, silica. The small-diameter Si-containing particles and the large-diameter Si-containing particles are added to negatively charge toner and to provide flowability. The small-diameter Si-containing particles and the large-diameter Si-containing particles may be prepared by a dry process using halogenated Si particles or by a wet process using a Si compound precipitated in a solution. The small-diameter Si-containing particles may have a volume average particle diameter of about 5 nm to about 20 nm and may provide toner with flowability. The large-diameter Si-containing particles may have a volume average particle diameter of about 30 nm to about 100 nm and may facilitate separation of individual mother toner particles without external additives from each other or from a surface of toner.

The amount of the small-diameter Si-containing particles may be, for example, in the range of about 0.1 to about 2.0 parts by weight, about 0.3 to about 1.5 parts by weight, or about 0.5 to about 1.0 part by weight, based on 100 parts by weight of mother toner particles. If the amount of the small-diameter Si-containing particles is within the range of about 0.1 to about 2.0 parts by weight, fixability may be improved, and overcharging and poor cleaning may be prevented.

The amount of the large-diameter Si-containing particles may be, for example, in the range of about 0.1 to about 3.5 parts by weight, about 0.5 to about 3.0 parts by weight, or about 1.0 to about 2.5 parts by weight, based on 100 parts by weight of mother toner particles. If the amount of the large-diameter Si-containing particles is within the range of about 0.1 to about 3.5 parts by weight, problems, such as a reduction in fixability, overcharging, contamination, filming or the like, may be prevented.

The amount of the small-diameter Si-containing particles may be, for example, in the range of about 0.1 to about 2.0 parts by weight, about 0.3 to about 1.5 parts by weight, or about 0.5 to about 1.0 part by weight, based on 100 parts by weight of mother toner particles. If the amount of the small-diameter Si-containing particles is within the range of about 0.1 to about 2.0 parts by weight, fixability may be improved, and overcharging and poor cleaning may be prevented.

An example of the Ti-containing particles may include, but is not limited to, titanium dioxide. The Ti-containing particles increase the amount of charges and are also environmentally friendly. In particular, a charge-up of toner in a low-temperature, low-humidity condition and a charge-down of toner in a high-temperature, high-humidity condition may be prevented. The Ti-containing particles may improve flowability of toner and may maintain a high transfer efficiency even after a large number of printing operations have been performed. The Ti-containing particles may have a volume average particle diameter of about 10 nm to about 200 nm. The amount of the Ti-containing particles may be in the range of about 0.1 to about 2.0 parts by weight, about 0.3 to about 1.5 parts by weight, or about 0.5 to about 1.0 parts by weight, based on 100 parts by weight of mother toner particles. If the amount of the Ti-containing particles is within the range of about 0.1 to about 2.0 parts by weight, charging properties may be maintained regardless of environmental conditions, and image contamination and a reduction of charge amount may be prevented.

Examples of the Sr-containing particles may include, but is not limited to, strontium titanate, strontium oxide, strontium carbonate, and strontium sulfate. The Sr-containing particles provide toner with long-life durability and excellent charging properties, and also function as micro-carriers to reduce the amount of wrong-sign toner that is generated by frictional charging of toner particles. The Si-containing particles provide toner with tolerance to stress between a developing roller and a regulating blade.

The Sr-containing particles may have a volume average particle diameter (D50v) of about 200 to about 500 nm, and a volume average particle diameter distribution, which is represented by [(D84v−D16v)/2], of about 0.1 or less. The volume average particle diameters D16v, D50v and D84v denote cumulative particle diameters at 16%, 50%, and 84%, respectively, of the cumulative volume distribution of toner particles measured using the Coulter method. If the volume average particle diameter and the volume average particle size distribution of the Sr-containing particles are within the ranges above, the Sr-containing particles may not be separated from toner after being externally added, and may not agglomerate each other, thereby maintaining the charging properties of toner regardless of environmental conditions.

The amount of the Sr-containing particles may be, for example, in the range of about 0.05 to about 2.0 parts by weight, about 0.07 to about 1.5 parts by weight, or about 0.1 to about 1.0 parts by weight, based on 100 parts by weight of mother toner particles. If the amount of the Sr-containing particles is within the range of about 0.05 to about 2.0 parts by weight, the Sr-containing particles may not be separated from the surface of toner and may not agglomerate each other, thereby improving durability of toner.

According to another aspect of the disclosure, an imaging method may include: attaching toner to a surface of a photoreceptor on which an electrostatic latent image is formed, so as to form a visible image; and transferring the visible image onto a transfer medium, wherein the toner may include a binder, a colorant and a releasing agent, wherein the electrophotographic toner includes strontium (Sr), iron (Fe), titanium (Ti), and silicon (Si) containing particles; wherein, if [Sr], [Fe], [Ti] and [Si] denote the intensities of Sr, Fe, Ti, and Si in the electrophotographic toner, respectively, as measured by X-ray fluorescence spectrometry, then the [Sr]/[Fe] ratio is in the range of about $5.0\times10^{-1}$ to about 4.5, the [Ti]/[Fe] ratio is in the range of about $5.0\times10^{-1}$ to about $8.1\times10^{-1}$, and the [Si]/[Fe] ratio is in the range of about $2.0\times10^{-3}$ to about $4.0\times10^{-3}$.

A representative electrophotographic imaging process includes a series of imaging steps onto a receptor, including charging, exposing to light, developing, transferring, fixing, cleaning, and erasing processes.

In the charging process, a surface of a photoreceptor is charged with negative or positive charges, whichever is desired, by a corona discharge or a charge roller.

In the exposing to light process, the charged surface of the photoreceptor is selectively discharged using a laser scanner or an array of diodes in an image-wise manner in order to form a latent image corresponding to a final visual image to be formed on a final-image receptor, such as, for example, a sheet of paper. Electromagnetic radiation that may be referred to as "light radiation" may include, but is not limited to, infrared radiation, visible light radiation, and ultraviolet radiation.

In the developing process, in general appropriate polar toner particles contact the latent image on the photoreceptor. An electrically-biased developer having the same potential polarity as the polarity of toner is used. The toner particles move to the photoreceptor and are selectively attached to the latent image by an electrostatic force to form a toner image on the photoreceptor.

In the transferring process, the toner image is transferred to the final-image receptor from the photoreceptor. An intermediate transfer element is often used to aid subsequent transfer of the toner image from the photoreceptor, for example, to the final-image receptor.

In the fixing process, the toner image on the final-image receptor is heated to soften or melt toner particles, thereby fixing the toner image to the final-image receptor. An alternative fixing method may involve fixing the toner image to the final-image receptor under high pressure with or without the application of heat.

In the cleaning process, residual toner remaining on the photoreceptor is removed.

Finally, in the erasing process, the photoreceptor are exposed to light having a predetermined wavelength to substantially uniformly reduce the amount of charges on the photoreceptor, thereby removing the residue of the original latent image from the photoreceptor. As a result, the photoreceptor is ready for a next imaging cycle.

According to another aspect of the disclosure, a toner supplying unit may include: a) a toner tank in which toner may be stored; b) a supplying part protruding from an inner surface of the toner tank to externally supply toner from the toner tank; and c) a toner-agitating member rotatably disposed inside the toner tank to agitate toner in almost the entire inner space of the toner tank including a space above a top surface of the supplying part, wherein the toner may be used to develop an electrostatic latent image, and may include a latex, a colorant and a releasing agent, wherein the electrophotographic toner includes strontium (Sr), iron (Fe), titanium (Ti), and silicon (Si) containing particles; wherein, if [Sr], [Fe], [Ti] and [Si] denote the intensities of Sr, Fe, Ti, and Si in the electrophotographic toner, respectively, as measured by X-ray fluorescence spectrometry, then the [Sr]/[Fe] ratio is in the range of about $5.0\times10^{-1}$ to about 4.5, the [Ti]/[Fe] ratio is in the range of about $5.0\times10^{-1}$ to about $8.1\times10^{-1}$, and the [Si]/[Fe] ratio is in the range of about $2.0\times10^{-3}$ to about $4.0\times10^{-3}$.

FIG. 1 is a view of a toner supplying unit 100. The toner supplying unit 100 may include a toner tank 101, a supplying part 103, a toner-conveying member 105 and a toner-agitating member 110. The toner tank 101 is configured to store a predetermined amount of toner, and may have a substantially hollow cylindrical shape. The supplying part 103 may be disposed on an inner bottom surface of the toner tank 101, and may be configured to externally discharge toner contained in the toner tank 101. For example, the supplying part 103 may protrude from the bottom of the toner tank 101 to have a pillar shape with a semi-circular cross-section. The supplying part 103 may include a toner outlet (not shown) in an outer side, through which toner outlet the toner may be discharged.

The toner-conveying member 105 may be disposed at a side of the supplying part 103 on the inner bottom surface of the toner tank 101. The toner-conveying member 105 may have, for example, a coil spring shape. An end of the toner-conveying member 105 may extend inside the supplying part 103 so that toner in the toner tank 101 is conveyed into the supplying part 103 as toner-conveying member 105 rotates. Toner conveyed by the toner-conveying member 105 may be externally discharged through the toner outlet of the supplying part 103.

The toner-agitating member 110 is rotatably disposed inside the toner tank 101 and forces toner in the toner tank 101 to move in a radial direction. For example, when the toner-agitating member 110 rotates at a middle of the toner tank 101, toner in the toner tank 101 is agitated to prevent toner from solidifying. As a result, toner moves down to the bottom of the toner tank 101 due to gravity. The toner-agitating member 110 includes a rotation shaft 112 and a toner-agitating film 120. The rotation shaft 112 is rotatably disposed at the middle of the toner tank 101, and may have a driving gear (not shown) that may be coaxially coupled with an end of the rotation shaft 112 protruding from a side of the toner tank 101. The rotation of the driving gear causes the rotation shaft 112 to rotate. The rotation shaft 112 may also have a support plate 114 to help fix toner-agitating film 120 to the rotation shaft 112. The support plate 114 may be formed to be substantially symmetric about the rotation shaft 112. The toner-agitating film 120 has a width corresponding to the inner length of the toner tank 101. The toner-agitating film 120 may be elastically deformable in consideration of the shape of a projection inside the toner tank 101, i.e., the supply part 103. The toner-agitating film 120 may include a first agitating part 121 and a second agitating part 122 formed by cutting an end of the toner-agitating film 120 toward the rotation shaft 112 by a predetermined length.

According to another aspect of the disclosure, an imaging apparatus includes: an photoreceptor; an imaging unit for forming an electrostatic latent image on the photoreceptor; a unit for containing toner; a toner supply unit for supplying toner to the photoreceptor so as to develop the electrostatic latent image into a toner image on the photoreceptor; and a toner transfer unit for transferring the toner image formed on the photoreceptor to a transfer medium. The toner may be used to develop an electrostatic latent image and may include a binder, a colorant, and a releasing agent. The absolute value of a complex viscosity of the toner at a temperature of 100° C. to 160° C. may be obtained using a differential equation ($d\eta/dT$), and be in the range of about 0.03 to about 0.06, and a complex viscosity ($\eta$) of the toner at 100° C. may be in the range of about $1.0\times10^2$ Pa·s to about $6.0\times10^2$ Pa·s.

Figure 2:
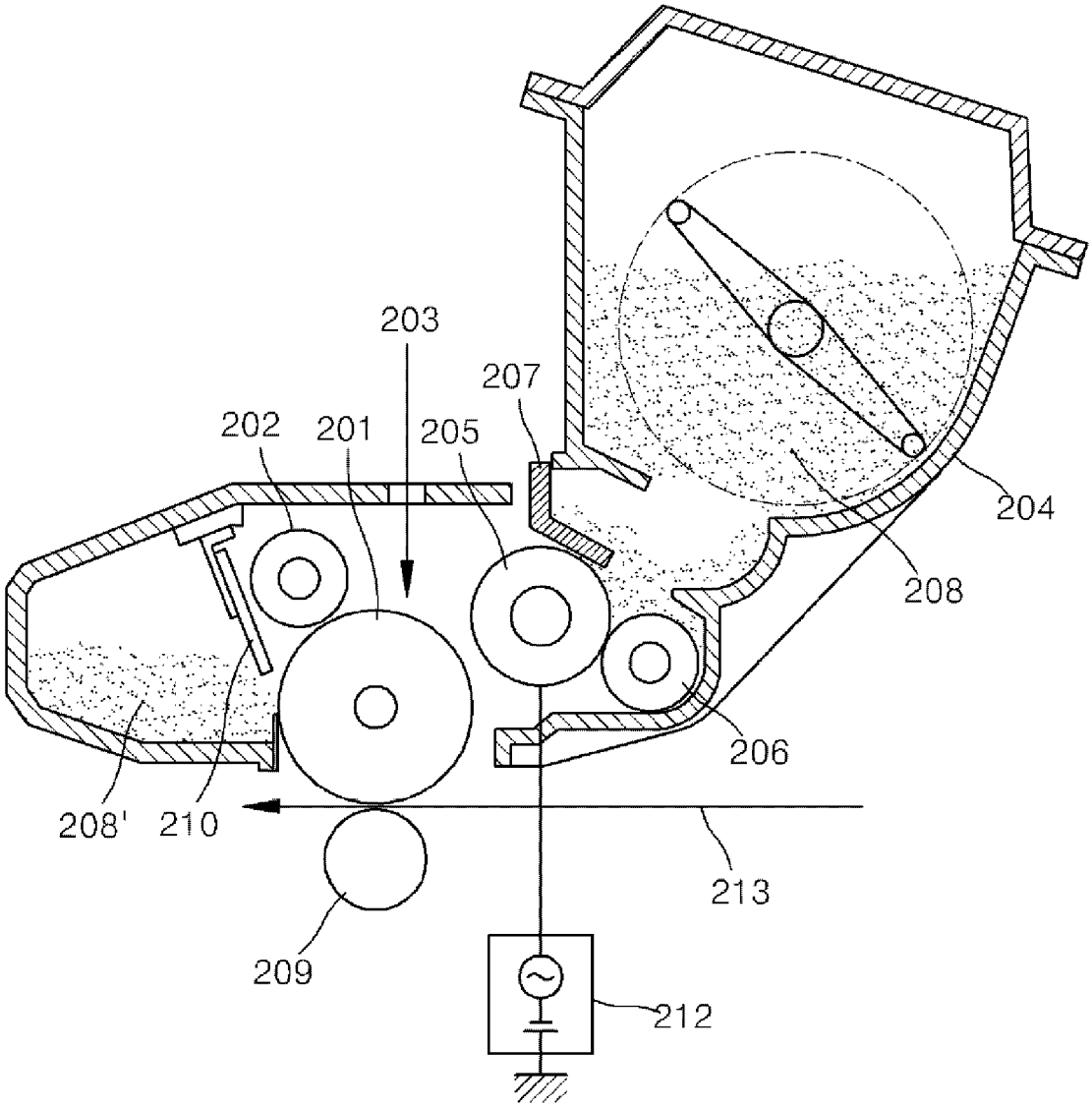
FIG. 2 is a schematic view of a toner imaging apparatus.

FIG. 2 is a schematic view of a non-contact development type imaging apparatus utilizing toner prepared by the disclosed methods.

A developer 208, which includes a nonmagnetic one-component, of a developing device 204 is supplied to a developing roller 205 by a supply roller 206 formed of an elastic material, such as polyurethane foam or sponge. The developer 208 supplied to the developing roller 205 reaches a contact portion between a developer-regulating blade 207 and the developing roller 205 as the developing roller 205 rotates. The developer-regulating blade 207 may be formed of an elastic material, such as metal or rubber. When the developer 208 passes through the contact portion between the developer-regulating blade 207 and the developing roller 205, the developer 208 is regulated to form a thin layer having a uniform thickness and is sufficiently charged. The developer 208 formed into a thin layer is transferred to a development region of a photoreceptor 201, which functions as an image carrier, by the developing roller, wherein an electrostatic latent image is developed in the development region. The electrostatic latent image may be formed by scanning light 203 onto the photoreceptor 201.

The developing roller 205 is arranged to face the photoreceptor 201 while being spaced apart from the photoreceptor 201 by a predetermined distance. The developing roller 205 and the photoreceptor 201 may rotate in opposite directions with respect to each other. For example, the developing roller 205 may rotate in a counterclockwise direction while the photoreceptor 201 may rotate in a clockwise direction.

The developer 208 transferred to the development region of the photoreceptor 201 develops the electrostatic latent image formed on the photoreceptor 201 into a toner image, wherein the electrostatic latent image is formed by an electric force generated due to a potential difference between a direct current (DC) biased alternating current (AC) voltage applied to the developing roller 205 and a latent potential of the photoreceptor 201 charged by a charging unit 202.

The developer 208 developed on the photoreceptor 201 reaches a region of a transfer unit 209 according to a rotation direction of the photoreceptor 201. The developer 208 developed on the photoreceptor 201 is transferred to a print medium 213 by the transfer unit 209 having a roller shape and to which a high voltage having a polarity opposite to the developer 208 is applied, or by corona discharging, while the print medium 213 passes between the photoreceptor 201 and the transfer unit 209.

While the image transferred to the print medium 213 passes through a high-temperature and high-pressure fusing device (not shown), the developer 208 is fused to the print medium 213, thereby fixing the image. A non-developed, residual developer 208' on the developing roller 205 is collected by the supply roller 206 contacting the developing roller 205, and a non-developed, residual developer 208' on the photoreceptor 201 is collected by a cleaning blade 210. These processes may be repeated for formation of subsequent images.

EXAMPLES

Hereinafter, one or more embodiments of the present disclosure will be described in more detail with reference to the following examples. These examples are not intended to limit the scope of the embodiments of the disclosure.

Scanning electron microscopic (SEM) images of toners prepared according to the following examples were obtained to identify shapes of toners. The circularity of toners was obtained using an FPIA-3000 (SYSMEX Corp.), and using the equation below:

$$\text{Circularity}=2\times(\pi\times\text{area})^{0.5}/\text{circumference}$$

The circularity may be in the range of 0 to 1, and as the circularity approaches 1, toner particle shape becomes more circular.

Example 1

Synthesis of Primary Binder Particles

A polymerizable monomer mixed solution (970 g of styrene and 192 g of n-butyl acrylate), 36 g of β-carboxyethylacrylate (Sipomer, Rhodia), 4.2 g of decandiol diacrylate as a crosslinker, and 18.8 g of 1-dodecanethiol as a chain transfer agent (CTA) were added to a 3 L beaker, and 500 g of a 2% aqueous solution of sodium dodecyl sulfate (Aldrich) as an emulsifier was added to the mixture and stirred to prepare a polymerizable monomer emulsion. Separately, 18 g of ammonium persulfate (APS) as an initiator and 1,160 g of a 0.13% aqueous solution of sodium dodecyl sulfate (Aldrich) as an emulsifier were added to a 3 L double-jacketed reactor heated to a temperature of 75° C. While stirring this mixture, the polymerizable monomer emulsion prepared above was slowly dropwise added into the mixture for two hours or longer. The mixture was reacted at a reaction temperature for 8 hours to obtain primary binder particles. The particle size of the primary binder particles was measured by light scattering (Horiba 910). The average particle size was in the range of about 150 to about 200 nm. In this case, the toner concentration was 42.3%.

Preparation of Colorant Dispersion 10 g of a 1:1 mixture of an anionic reactive emulsifier (HS-10; DAI-ICH KOGYO) and a nonionic reactive emulsifier (RN-10; DAI-ICH KOGYO) was added to a milling bath together with 60 g of a cyan colorant, and 400 g of glass beads having a diameter of about 0.8 to about 1 mm were added and milled at room temperature to prepare a colorant dispersion. A homogenizer used in this experiment was an ultrasonic wave homogenizer (Sonic and materials, VCX750).

Agglomeration and Preparation of Toner 500 g of deionized water, 150 g of the primary binder particles, 35 g of 19.5% cyan colorant dispersion (HS-10, 100%), and 28 g of a 35% releasing agent dispersion P-420 including 25-35% of paraffin wax and 5-10% of synthetic ester wax (a viscosity of 13 mPa·s at 25° C.; a melting point of 89° C., manufactured by Chukyo Yushi Co., Ltd) were added to a 1 L reactor. 30 g of nitric acid (0.3 mol), and 15 g of 12% PSI-100 (manufactured by Suido Kiko Co.) as an agglomerating agent were added to the mixture. The mixture was stirred at 11,000 rpm for 6 minutes by using a homogenizer to prepare core-layer particles having a volume average particle diameter of about 1.5 to about 2.5 μm. When the volume average diameter of the core-layer particles reached about 5.8 μm, 50 g of secondary binder particles obtained by polymerizing polystyrene-based polymerizable monomers was added. When the volume average particle diameter of agglomerated toner particles in the reaction solution reached 6.0 μm, a NaOH solution (1 mol) was added to adjust the pH to 8. The volume average particle diameter was maintained constant for 10 minutes, and the temperature was increased to 96° C. at a rate of 0.5° C./min. After the temperature reached 96° C., a nitric acid (0.3 mol) was added to adjust the pH to 6.6. The mixture was coalesced for about 3 to about 5 hours until toner particles having a potato-like shape and a particle size of about 5 to about 6 μm were obtained. The agglomerated toner particles in the reaction solution were cooled to a temperature lower than Tg, and were filtered to isolate toner particles, followed by drying. The toner particles had a glass transition temperature ($T_g$) of 58.8° C., a molecular weight of Mw 85,000, and a gel content of 3.8%.

0.6 parts by weight of large-diameter silica (RY50, available from Nippon Aerosil Co., Ltd. of Osaka, Japan), 0.8 parts by weight of small-diameter silica (RX-200, available from Nippon Aerosil Co., Ltd.), 1.5 parts by weight of titanium dioxide (STT-30A, available from Titan Kogyo Kabushiki Kaisha of Ube, Japan), 0.9 parts by weight of strontium titanate (SW350, available from Titan Kogyo Kabushiki Kaisha) were added to 100 parts by weight of dried toner particles and stirred using a mixer (KM-LS2K, available from DAEWHA TECH Co., Ltd. of Yong-In, South Korea) at a rate of 6,000 rpm for 3 minutes. Toner had a GSDp of 1.272 and a GSDv of 1.221. The average circularity of toner was 0.973.

Examples 2 to 7

Toner was prepared in the same manner as in Example 1, except that the amounts of large-diameter silica, small-diameter silica, titanium dioxide and strontium titanate with respect to 100 parts by weight of dried toner particles were varied as shown in Table 2.

Comparative Examples 1 to 6

Toner was prepared in the same manner as in Example 1, except that the amounts of large-diameter silica, small-diameter silica, titanium dioxide and strontium titanate with respect to 100 parts by weight of dried toner particles were varied as shown in Table 2.

TABLE 2

| | Large-diameter silica ($SiO_2$) | Small-diameter silica ($SiO_2$) | Titanium dioxide ($TiO_2$) | Strontium titanate ($SrTiO_3$) |
|---|---|---|---|---|
| Example 1 | 1.6 | 0.8 | 1.5 | 0.9 |
| Example 2 | 1.6 | 0.8 | 1.5 | 0.3 |
| Example 3 | 1.6 | 0.8 | 1.5 | 0.1 |
| Example 4 | 1.6 | 0.8 | 1.2 | 0.3 |
| Example 5 | 1.6 | 0.8 | 1.8 | 0.3 |
| Example 6 | 1.2 | 0.8 | 1.5 | 0.3 |
| Example 7 | 2.0 | 0.8 | 1.5 | 0.3 |
| Comparative Example 1 | 1.6 | 0.8 | 1.5 | 0.0 |
| Comparative Example 2 | 1.6 | 0.8 | 1.5 | 1.2 |
| Comparative Example 3 | 1.6 | 0.8 | 0.9 | 0.3 |
| Comparative Example 4 | 1.6 | 0.8 | 2.1 | 0.3 |
| Comparative Example 5 | 0.8 | 0.8 | 1.5 | 0.3 |
| Comparative Example 6 | 2.4 | 0.8 | 1.5 | 0.3 |

Evaluation of Toner—X-ray Fluorescence Measurement

An X-ray fluorescence measurement of each of the samples was performed using an energy dispersive X-ray spectrometer (EDX-720, available from SHIMADZU Corp. of Kyoto, Japan). An X-ray tube voltage was 50 kV, and the amounts of samples that were molded were 3 g±0.01 g. For each sample, [Sr]/[Fe], [Ti]/[Fe] and [Si]/[Fe] were calculated using intensities (unit: cps/uA) from quantitative results obtained by the X-ray fluorescence measurement.

Charge Distribution

After printing onto 10 sheets by using a printer (Color Laser 660, manufactured by Samsung Electronics Co., Ltd, the charge distribution of toner on the developing roller was measured using an E-Spart analyzer (Hosokawa Micron Ltd.).

◎: (+) charge %<10%

O: 10%≦(+) charge<20%

Δ: 20%≦(+) charge≦30%

X: (+) charge>30%

Developing Characteristics

While raising a development voltage of a non-contact one-component developing system in units of 50V, a voltage range in which uniformity of a halftone image is ensured, i.e., a voltage range in which no regional difference in optical density of a halftone image occurs, was measured.

◎: Halftone image is uniform at 200V

O: Halftone image is uniform at a voltage of 100 to 150V

Δ: Halftone image is uniform at a voltage of 50 to 100V

X: Halftone image is uniform at less than 50V

Optical Photoconductor (OPC) Background (BG) Optical Density

After printing onto 10 sheets by using a printer (Color Laser 660, manufactured by Samsung Electronics Co. Ltd.), a non-image region of a photoreceptor drum was taped to measure an optical density using a densitometer (SpectroEye, manufactured by Samsung Electronics Co. Ltd.)

◎: OD<0.03

O: 0.03≦OD≦0.05

Δ: 0.05≦OD≦0.08

X: 0.08≦OD

Development Durability

1% coverage pattern was continuously printed until a solid pattern having a sufficient toner concentration could no longer be printed by using a printer (Color Laser 660, manufactured by Samsung Electronics Co. Ltd.) to measure lifetime thereof.

◎: Toner concentration is maintained until printing onto 5,000 sheets or more

O: Toner concentration is maintained until printing onto 3,000 to 5,000 sheets

Δ: Toner concentration is maintained until printing onto 1,000 to 3,000 sheets

X: Toner concentration is maintained until printing onto 1,000 sheets or less

TABLE 3

| | Results of X-ray fluorescence measurement | | | Charge | Developing | OPC BG | Development |
|---|---|---|---|---|---|---|---|
| | [Sr]/[Fe] | [Ti]/[Fe] | [Si]/[Fe] | distribution | characteristics | Optical density | durability |
| Example 1 | 4.11 | 0.62 | 0.0031 | | | | |
| Example 2 | 1.22 | 0.60 | 0.0032 | | | | |
| Example 3 | 0.49 | 0.59 | 0.0030 | ○ | ○ | ○ | ○ |
| Example 4 | 1.23 | 0.48 | 0.0031 | | ○ | | ○ |
| Example 5 | 1.30 | 0.79 | 0.0032 | ○ | | ○ | |
| Example 6 | 1.24 | 0.59 | 0.0025 | ○ | ○ | ○ | ○ |
| Example 7 | 1.25 | 0.63 | 0.0037 | | ○ | ○ | |
| Comp. Example 1 | 0 | 0.61 | 0.0030 | X | | | |
| Comp. Example 2 | 5.42 | 0.64 | 0.0031 | ○ | X | ○ | |
| Comp. Example 3 | 1.21 | 0.34 | 0.0032 | ○ | X | ○ | X |
| Comp. Example 4 | 1.20 | 0.85 | 0.0031 | X | ○ | X | ○ |
| Comp. Example 5 | 1.24 | 0.64 | 0.0019 | X | | | X |
| Comp. Example 6 | 1.23 | 0.62 | 0.0042 | ○ | X | | |

Referring to Table 3, the electrophotographic toners of Example 1 through 7, wherein the [Sr]/[Fe] ratio is in the range of about $5.0\times10^{-1}$ to about 4.5, the [Ti]/[Fe] ratio is in the range of about $5.0\times10^{-1}$ to about $8.0\times10^{-1}$, and the [Si]/[Fe] ratio is in the range of about $2.0\times10^{-3}$ to about $4.0\times10^{-3}$, were excellent in terms of charge distribution, developing characteristics, OPC BG optical density and development durability, compared to toners of Comparative Examples 1 through 6, wherein one of these ratios is out of the above ranges. In this regard, [Sr], [Fe], [Ti] and [Si] denote the intensities of Sr, Fe, Ti and Si, respectively, as measured by X-ray fluorescence spectrometry.

Since the surface of toner is treated with inorganic particles, the toner may exhibit excellent charging characteristics when contacting a developing roller and a regulating blade in one-component non-contact and contact developing systems, and may form a large development area with durability against stress. The amount of toner transferred to a non-image region of a photoreceptor drum may be reduced, so that toner consumption is reduced. The toner may have excellent preservation characteristics that are stable against the high-temperature developing member.

While the disclosure has been particularly shown and described with reference to exemplary embodiments thereof, it will be understood by those of ordinary skill in the art that various changes in form and details may be made therein without departing from the spirit and scope of the disclosure as defined by the following claims.

What is claimed is:

1. An electrophotographic toner comprising a binder, a colorant and a releasing agent, wherein the electrophotographic toner comprises strontium (Sr), iron (Fe), titanium (Ti), and silicon (Si) containing particles; wherein [Sr], [Fe], [Ti] and [Si] denote the intensities of Sr, Fe, Ti, and Si in the electrophotographic toner, respectively, as measured by X-ray fluorescence spectrometry, wherein the [Sr]/[Fe] ratio is in the range of about $5.0\times10^{-1}$ to about 4.5, the [Ti]/[Fe] ratio is in the range of about $5.0\times10^{-1}$ to about $8.1\times10^{-1}$, and wherein the [Si]/[Fe] ratio is in the range of about $2.0\times10^{-3}$ to about $4.0\times10^{-3}$.

2. The electrophotographic toner of claim 1, wherein Sr is in the form of Sr-containing particles having a volume average particle diameter (D50v) of about 200 to about 500 nm, and having a volume average particle size distribution, which is represented by [(D84v−D16v)/2], of about 0.1 or less, and wherein the volume average particle diameters D16v, D50v and D84v denote cumulative particle diameters at 16%, 50%, and 84%, respectively, of the cumulative volume distribution of toner particles measured using the Coulter method.

3. The electrophotographic toner of claim 2, wherein the Sr-containing particles comprise at least one selected from the group consisting of strontium titanate, strontium oxide, strontium carbonate, and strontium sulfate.

4. The electrophotographic toner of claim 1, wherein Si is in the form of Si-containing particles comprising large-diameter Si-containing particles having a volume average particle diameter of about 30 nm to about 100 nm; and small-diameter Si-containing particles having a volume average particle diameter of about 5 nm to about 20 nm.

5. The electrophotographic toner of claim 4, wherein the Si-containing particles comprise silica.

6. The electrophotographic toner of claim 1, wherein the amount of each of Si and Fe is in the range of about 3 to about 30,000 ppm.

7. The electrophotographic toner of claim 1, wherein the average particle diameter of the electrophotographic toner is in the range of about 3 to about 9.5 μm.

8. The electrophotographic toner of claim 1, wherein the average circularity of the electrophotographic toner is in the range of about 0.945 to about 0.985.

9. The electrophotographic toner of claim 1, wherein the volume average particle diameter distribution coefficient (GSDv) of the toner is about 1.25 or less, and the number average particle diameter distribution coefficient (GSDp) is about 1.3 or less.

10. A method of preparing the electrophotographic toner of claim 1, the method comprising the steps of:

a) mixing primary binder particles, a colorant dispersion and a releasing agent dispersion together to produce a mixed solution;

b) adding an agglomerating agent to the mixed solution to produce core-layer particles; and c) coating the core-layer particles with shell-layer particles to produce the electrographic toner, wherein the shell-layer particles comprise secondary binder particles prepared by polymerizing at least one polymerizable monomer.

11. The method of claim 10, wherein coating the core-layer particles with shell-layer particles of step c) comprises the steps of:

d) agglomerating the core-layer particles and the shell-layer particles at a temperature at which the core-layer particles and the shell-layer particles have a shear storage modulus (G') of about $1.0\times10^8$ to about $1.0\times10^9$ Pa;

e) stopping the agglomerating in step d) when the average particle diameter reaches about 70% to about 100% of the average particle diameter of the electrographic toner, to provide toner particles; and f) fusing and coalescing the toner particles obtained in step e) at a temperature at which the toner particles have a shear storage modulus (G') of about $1.0\times10^4$ to about $1.0\times10^9$ Pa.

12. The method of claim 10, further comprising coating the secondary toner particles with tertiary binder particles.

13. The method of claim 10, wherein the releasing agent dispersion comprises a paraffin-based wax and an ester-based wax.

14. The method of claim 13, wherein the amount of the ester-based wax is in the range of about 1 to about 35 parts by weight % based on the total weight of the paraffin-based wax and the ester-based wax.

15. The method of claim 10, wherein the agglomerating agent comprises a Si- and Fe-containing metal salt.

16. The method of claim 10, wherein the agglomerating agent comprises polysilicate iron.

17. The method of claim 10, wherein the agglomerating agent is added at a pH of about 2.0 or less.

* * * * *